US006334509B1

(12) United States Patent
Ryszkiewicz

(10) Patent No.: US 6,334,509 B1
(45) Date of Patent: Jan. 1, 2002

(54) STEPLADDER CADDY

(76) Inventor: Leonard Ryszkiewicz, 27 Clifton St., Central Falls, RI (US) 02863

( * ) Notice: Subject to any disclaimer, the term of this patent is extended or adjusted under 35 U.S.C. 154(b) by 0 days.

(21) Appl. No.: 09/565,955

(22) Filed: May 5, 2000

(51) Int. Cl.[7] ..... E04G 1/00; B65D 85/28
(52) U.S. Cl. ..... 182/129; 248/210; 206/372
(58) Field of Search ..... 182/129; 248/210, 248/238; 220/570, 523; 206/372, 373

(56) References Cited

U.S. PATENT DOCUMENTS

| | | | | | |
|---|---|---|---|---|---|
| 4,653,713 | A | * | 3/1987 | Hamilton | 182/129 X |
| 4,706,918 | A | * | 11/1987 | Wilson | 182/129 X |
| 4,720,021 | A | * | 1/1988 | Byrns | 206/373 X |
| 5,358,070 | A | * | 10/1994 | Bartnicki et al. | 182/129 X |
| 5,501,355 | A | * | 3/1996 | Elzenbeck et al. | 206/372 X |
| 5,503,571 | A | * | 4/1996 | Cheslock | 206/372 X |
| 5,505,303 | A | * | 4/1996 | Sirman | 206/373 |
| 5,547,080 | A | * | 8/1996 | Klimas | 206/373 |
| 5,553,701 | A | * | 9/1996 | Jarecki et al. | 220/570 X |
| 5,603,405 | A | * | 2/1997 | Smith | 206/373 |
| 5,680,932 | A | * | 10/1997 | Dickinson et al. | 206/372 |
| 5,782,314 | A | | 7/1998 | Zeitler | |
| 5,882,097 | A | * | 3/1999 | Kohagen et al. | 206/372 X |
| 5,901,998 | A | | 5/1999 | Gallo, Jr. | |
| 5,913,380 | A | * | 6/1999 | Gugel et al. | 182/129 |
| 5,941,344 | A | | 8/1999 | Spadaro | |
| 5,950,972 | A | * | 9/1999 | Irish | 248/210 |
| 5,967,259 | A | | 10/1999 | Williams | |
| 5,971,102 | A | * | 10/1999 | Brown | 182/129 |
| 6,012,689 | A | * | 1/2000 | Sisca | 248/210 |
| 6,098,748 | A | * | 8/2000 | Harper et al. | 182/129 |

* cited by examiner

*Primary Examiner*—Alvin Chin-Shue
*Assistant Examiner*—Hugh B. Thompson
(74) *Attorney, Agent, or Firm*—Henderson & Sturm LLP

(57) ABSTRACT

A stepladder caddy including first and second containers interconnected by a horizontal top plate and downwardly and outwardly disposed front and rear flanges. When positioned on the top step of a stepladder, the top plate rests on the top step, the front and rear flanges rest on the upper portion of the front and rear legs, and the first and second containers are disposed on opposite lateral sides of the top step where they are readily accessible to a worker. The top plate is positioned down from the top peripheral edges of the first and second containers and the front flange extends up to the top peripheral edges to form a ridge so that objects placed on the top plate are restrained from sideways or forward movement. The second container is tapered and includes a raised grid surface for removing excess paint from a roller or brush. The second container also includes a cover with a hollow vertical handle sized to receive the handle of a paint roller extending from the second container. Hand-grip openings formed in the first and second containers, and a recessed handle attached to the top plate may be used to transport the caddy when not in use on a stepladder.

7 Claims, 3 Drawing Sheets

STEPLADDER CADDY

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of work accessories, and more particularly to a stepladder caddy.

2. Description of Related Art

As can be seen by reference to the following U.S. Pat. Nos. 5,782,314; 5,901,998; 5,941,344 and 5,967,259 the prior art is replete with myriad and diverse stepladder tool organizers.

While all of the aforementioned prior art constructions are more than adequate for the basic purpose and function for which they have been specifically designed, they are uniformly deficient with respect to their failure to provide a simple, efficient, and practical stepladder caddy.

As a consequence of the foregoing situation, there has existed a longstanding need for a new and improved stepladder caddy and the provision of such a construction is a stated objective of the present invention.

BRIEF SUMMARY OF THE INVENTION

Briefly stated, the present invention provides a stepladder caddy including first and second containers interconnected by a horizontal top plate and downwardly and outwardly disposed front and rear flanges. When positioned on the top step of a stepladder, the top plate rests on the top step, the front and rear flanges rest on the upper portion of the front and rear legs, and the first and second containers are disposed on opposite lateral sides of the top step where they are readily accessible to a worker. The top plate is positioned down from the top peripheral edges of the first and second containers and the front flange extends up to the top peripheral edges to form a ridge so that objects placed on the top plate are restrained from sideways or forward movement. The second container is tapered and includes a raised grid surface for removing excess paint from a roller or brush. The second container also includes a cover with a hollow vertical handle sized to receive the handle of a paint roller extending from the second container. Hand-grip openings formed in the first and second containers, and a recessed handle attached to the top plate may be used to transport the caddy when not in use on a stepladder.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
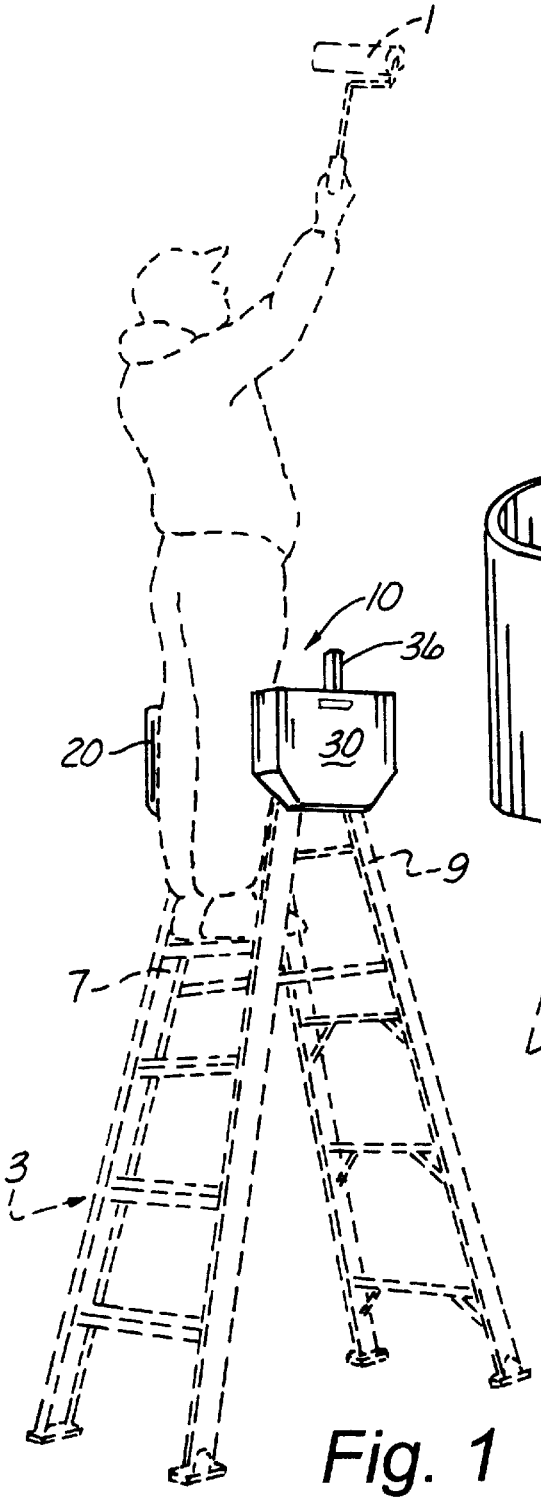
FIG. 1 is a perspective view of the stepladder caddy of the present invention in use on a stepladder with the first and second containers being disposed on opposite lateral sides of the stepladder.
Figure 2:
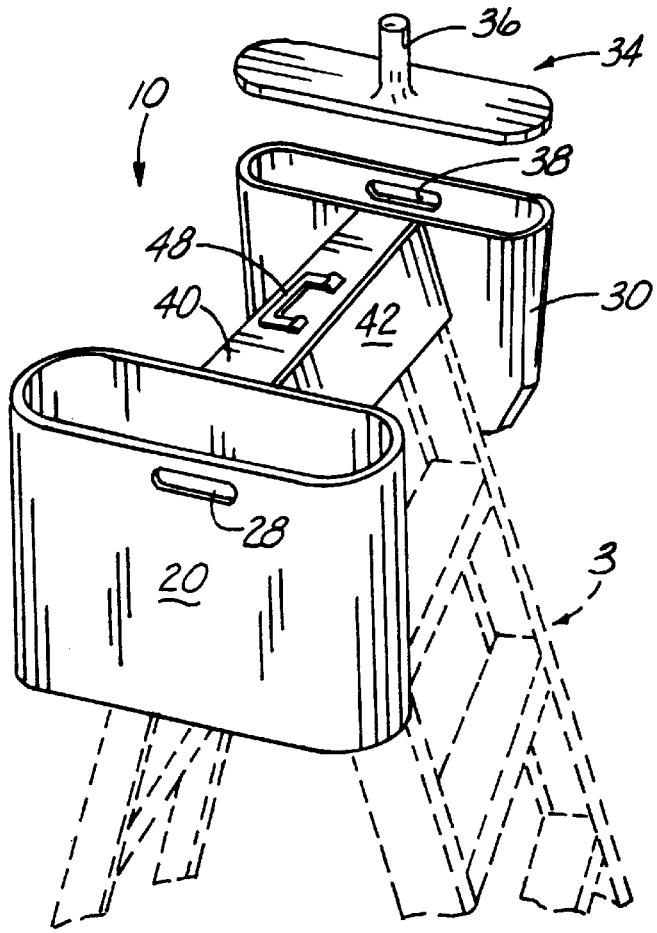
FIG. 2 is an enlarged perspective view showing the cover for the second container being positioned on the second container.
Figure 3:
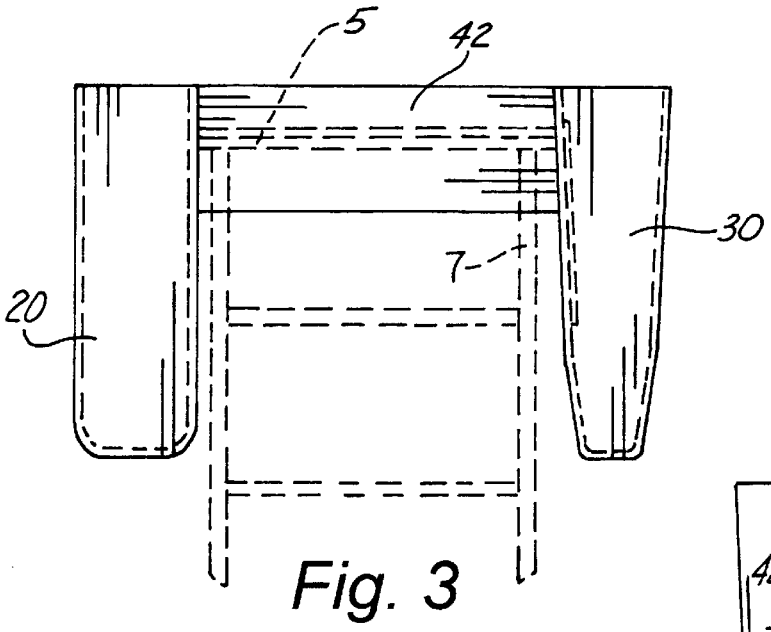
FIG. 3 is a side elevational view of the stepladder caddy.
Figure 5:
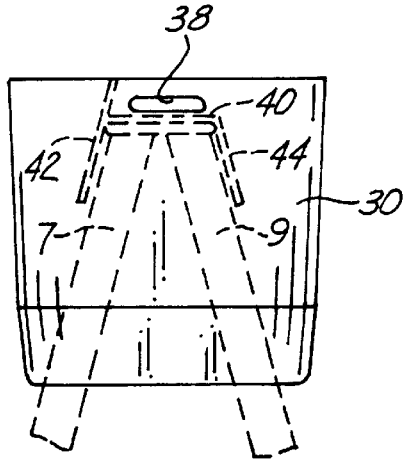
FIG. 5 is a right side elevational view thereof.
Figure 4:
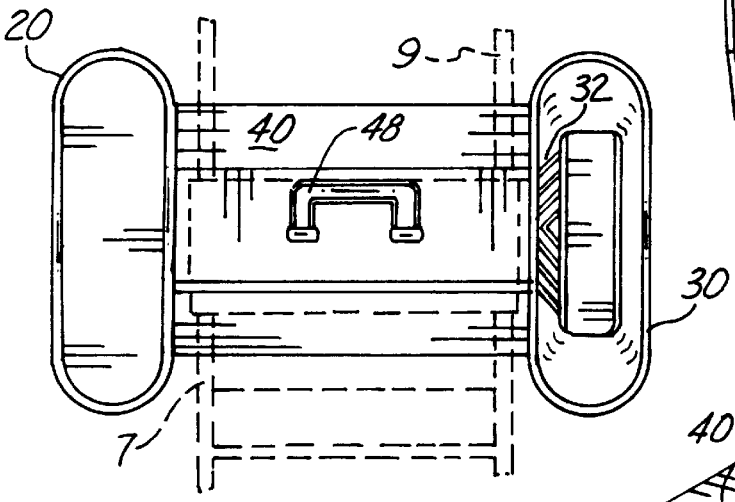
FIG. 4 is a top plan view thereof.
Figure 6:
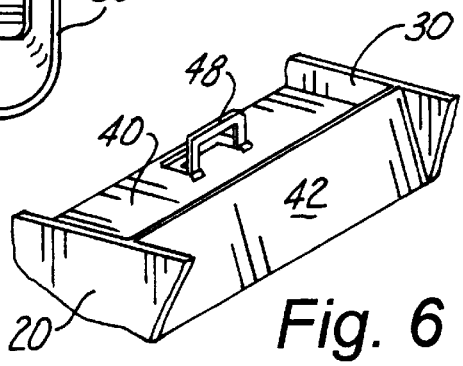
FIG. 6 is a partial perspective view of the stepladder caddy showing the handle on the top plate in the raised carrying position.
Figure 7:
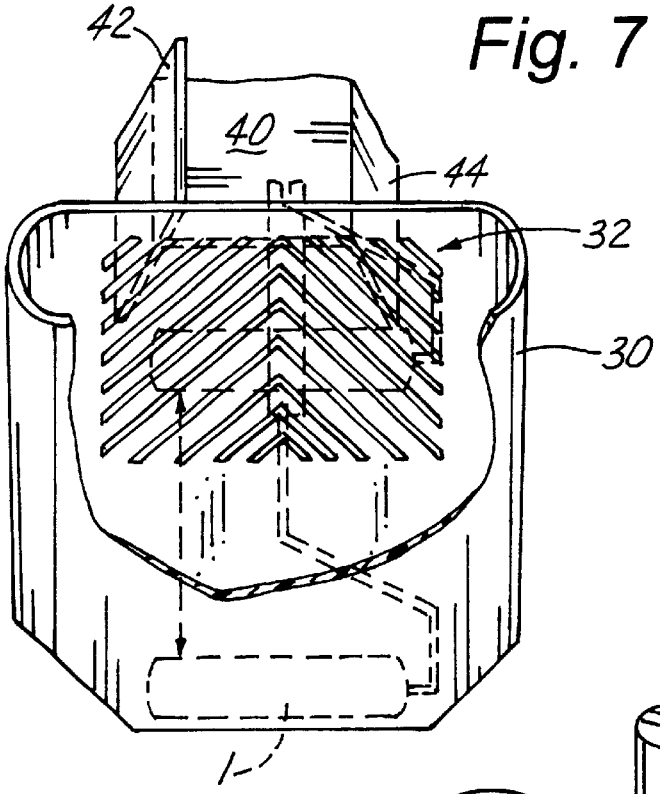
FIG. 7 is a right side partial perspective view with portions of the second container cut away to show the raised grid on the inner surface of the second container.
Figure 8:
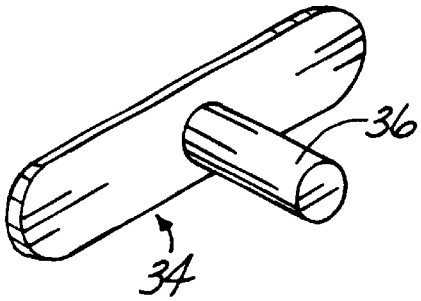
FIG. 8 is a perspective view of the cover for the second container.
Figure 9:
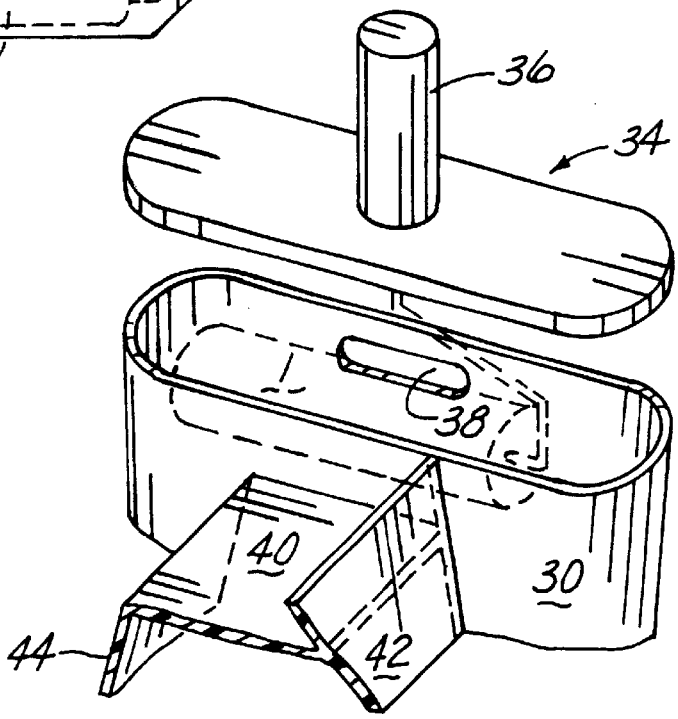
FIG. 9 is a left side partial perspective view showing the cover for the second container in a position similar to that illustrated in FIG. 2.

As can be seen by reference to the drawings, and in particularly to FIG. 1, the stepladder caddy that forms the basis of the present invention is designated generally by the reference number 10. The caddy 10 includes a first container 20 and a second container 30 interconnected by a horizontal top plate 40 and downwardly and outwardly disposed front and rear flanges 42 and 44. The top plate 40 is positioned down from the top peripheral edges of the first and second containers 20 and 30 and the front flange 42 extends up to the top peripheral edges to form a three-sided ridge around the top plate 40.

The second container 30 is tapered and includes an inner surface with a raised grid 32. The second container 30 also includes a cover 34 with a hollow vertical handle 36 sized to receive the handle of a paint roller 1. Hand-grip openings 28 and 38 are formed in the first and second containers 20 and 30, respectively, and a recessed handle 48 is pivotally attached to the top plate 40. It is to be understood that other types of handles may be used in conjunction with the containers 20 and 30 and the top plate 40.

In use, the caddy 10 is positioned on a stepladder 3 over the top step 5 so that the underside of the top plate 40 rests on the top step 5, the front and rear flanges 42 and 44 rest on the upper portion of the front and rear legs 7 and 9, and the first and second containers 20 and 30 are disposed on opposite lateral sides of the top step 5 where they are readily accessible to a person working on the stepladder 3.

The caddy 10 may be used by maintenance workers, painters, electricians, plumbers and others to hold various tools and supplies. The caddy 10 fits on any standard stepladder 3, provides safety and stability, can be used by left-handed or right-handed workers, and does not extend out further than the base legs of the stepladder 3 so that it can be positioned close to a wall.

When used for painting, the second container 30 may be filled with up to a gallon of paint and can accept a standard sized paint roller 1. The cover 34 provides an airtight seal for the paint in the second container so it will not evaporate or skin over during periods of non-use. The hollow handle 36 is sized to slip over the protruding handle of any paint roller 1 left in the second container 30. Also, the cover 34 may be used as a painter's pallette where the hollow handle 36 can hold a supply of paint and accept a small brush for use on small jobs such as trimming window frames.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A stepladder caddy for a stepladder having a top step and front and rear legs attached to and extending downwardly and outwardly from the top step, the stepladder caddy comprising:

first and second containers each having a closed bottom and an open top defined by a top peripheral edge wherein the second container is tapered inwardly from its top peripheral edge;

a cover disposed to overlie the open top of the second container, wherein the cover includes a centrally disposed upwardly extending hollow handle, wherein the hollow handle is sized to receive a handle of a paint roller disposed within the second container;

a horizontally disposed top plate having side edges, a front edge, and a rear edge, the side edges being attached to and interconnecting the first and second containers at a point between the closed bottom and open top such that a top portion of the first and second containers extends above the top plate and a bottom portion of the first and second containers extends below the top plate, the top plate being adapted to rest on the top step of the stepladder; and front and rear flanges attached respectively to the front and rear edges of the top plate and attached to and interconnecting the first and second containers, the front and rear flanges being disposed to extend downwardly and outwardly from the front and rear edges of the top plate and being adapted to rest on a top part of the front and rear legs of the stepladder.

2. The stepladder caddy of claim 1, wherein the front flange extends upwardly to the top peripheral edge of the first and second containers.

3. The stepladder caddy of claim 1 further including a handle attached to the top plate.

4. The stepladder caddy of claim 3 wherein the handle is pivotally attached to the top plate and is movable between a raised carrying position and a lowered storage position.

5. The stepladder caddy of claim 4 wherein the top plate includes a recessed area and the handle is received in the recessed area when it is in the lowered storage position.

6. The stepladder caddy of claim 1 further including hand-grip openings formed in the first and second containers.

7. The stepladder caddy of claim 1 wherein the second container includes an inner surface carrying a grid of spaced raised surfaces.

* * * * *